US006113462A

United States Patent [19]

Yang

[11] Patent Number: 6,113,462

[45] Date of Patent: Sep. 5, 2000

[54] FEEDBACK LOOP FOR SELECTIVE CONDITIONING OF CHEMICAL MECHANICAL POLISHING PAD

[75] Inventor: Kai Yang, Fremont, Calif.

[73] Assignee: Advanced Micro Devices, Inc., Sunnyvale, Calif.

[21] Appl. No.: 08/993,439

[22] Filed: Dec. 18, 1997

[51] Int. Cl.[7] ..... B24B 49/00; B24B 51/00

[52] U.S. Cl. ..... 451/5; 451/56; 451/443

[58] Field of Search ..... 451/63, 5, 21, 451/56, 287, 443, 444, 41, 28, 57, 285, 288, 268, 269

[56] References Cited

U.S. PATENT DOCUMENTS

| | | | |
|---|---|---|---|
| 34,425 | 2/1862 | Schultz | 451/63 |
| 4,999,954 | 3/1991 | Miyamoto et al. | 451/5 |
| 5,212,910 | 5/1993 | Breivogel et al. | 51/398 |
| 5,216,843 | 6/1993 | Breivogel et al. | 51/131.1 |
| 5,308,438 | 5/1994 | Cote et al. | 451/41 |
| 5,421,769 | 6/1995 | Schultz et al. | 451/287 |
| 5,664,987 | 9/1997 | Renteln | 451/21 |
| 5,791,969 | 8/1998 | Lund | 451/6 |

OTHER PUBLICATIONS

Article entitled "Selective Conditioning And Pad Degradation Studies On Interlayer Dielectric Films"; K. Achhuthan et al.; CMP–MIC Conference; Feb. 22–23, 1996.

*Primary Examiner*—Derris Holt Banks
*Attorney, Agent, or Firm*—Gerry Fisher

[57] ABSTRACT

An improved method and apparatus for Chemical Mechanical Polishing (CMP) in integrated circuit processing utilizes a film measurement feedback loop for progressively optimizing the polishing pad conditioning recipe. By utilizing this invention, non-uniform pad wearing and elastic property variations are substantially corrected, and Within-Wafer-Non-Uniformity (WIWNU) is minimized.

13 Claims, 7 Drawing Sheets

FEEDBACK LOOP FOR SELECTIVE CONDITIONING OF CHEMICAL MECHANICAL POLISHING PAD

FIELD OF THE INVENTION

This invention relates to integrated circuit manufacturing processes, and in particular to an apparatus and method for chemical mechanical polishing.

BACKGROUND OF THE INVENTION

In recent years, chemical mechanical polishing (CMP) has emerged as a viable and important process in integrated circuit fabrication. One of its most important applications is in planarization of interlevel dielectric layers (ILD's) in multilevel metallization structures, to improve lithographic resolution and to avoid metal step coverage problems. Another application of CMP is in the via fill process known as the Damascene process, wherein a metallic via plug is created by depositing metal into the via and onto the ILD surface, and the metal is thereafter polished off the surface leaving the via plug. A similar process, which forms the via plugs and the next level of interconnect metal in a single metal deposition, is known as the dual Damascene process. In this process, a second dielectric etch immediately follows the via etch, and forms a patterned recess in the ILD. Next, the metal is deposited and the surface excess is polished off using CMP, leaving the next level metal lines remaining in the ILD recesses. New applications for CMP in integrated circuit processing are still being identified.

CMP is generally performed by a polishing pad mounted on a hard platen, wherein the platen typically rotates during polishing. Wafers to be polished are positioned in a wafer carrier and inverted onto the polishing pad. A soft liner called the carrier film or carrier pad provides an interface between the hard wafer carrier and the wafer. The carrier film enables substantially uniform pressure to be applied to the wafer. Additionally, the high friction between the carrier film and the wafer generally results in no wafer rotation with respect to the carrier, although the wafer is not fixedly attached to the carrier. The carrier and wafer typically rotate about the carrier axis over the rotating platen, generally in the same direction, as illustrated in FIG. 2.

A polishing slurry is dispensed over the polishing pad to simultaneously provide mechanical abrasion and chemical interaction with the material to be polished, the mechanical and chemical components together causing surface material to be polished off. By way of example, a polishing slurry for polishing a silicon dioxide ILD film may comprise an $SiO_2$ colloid in $H_2O$, pH adjusted with KOH to have a pH value of 10—11.

Polishing rate, also termed removal rate, is a function of the applied pressure between wafer and polishing pad, as well as of the relative velocity between the two. It can be approximately modelled according to Preston's equation as $dT/dt=-(KZa)ds/dt$, where $dT/dt$=rate of change of thickness of the wafer $L/a$=applied pressure over area a (L is the load force on area a)

$ds/dt$=relative velocity between wafer and pad

K=Preston's coefficient, a proportionality constant which is not a function of pressure or relative velocity.

In the case of CMP, Preston's coefficient will account for the chemical component of the polishing process. In addition, the amount of slurry at the site in question may be a factor in determining the proportionality constant.

An ideal CMP process would provide uniform removal rate across each wafer, and constant removal rate as a function of polishing time. In reality, within-wafer-non-uniformity (WIWNU) is a widespread concern in virtually every application of CMP, particularly as wafer diameters increase. WIWNU of CMP removal rate affects the uniformity of dielectric or metal layer thickness, and can also cause dielectric or metal dishing. These effects degrade device functionality, reliability, manufacturability, and yield. Consequently, an important goal in CMP is to reduce WIWNU. WIWNU in metal and oxide CMP is greatly affected by geometrical and physical effects such as carrier pressure non-uniformity and slurry dispense non-uniformity, by way of example.

Dielectric CMP is generally performed using a polishing pad made of polyurethane, by way of example. The physical and chemical properties of this type of pad change as polishing proceeds, and these changes can contribute to WIWNU. It is known that the continuous compression experienced by the polishing pad causes gradual decrease in its elastic modulus, G. Since the pressure P exerted at a point on the pad is approximately expressed by the elastic equation $P=G\epsilon$, where $\epsilon$ is the strain of the pad at that point, changes in G can affect the local pressure and consequently the local removal rate. As is illustrated in FIG. 2, the central region 26 of the polishing pad, which passes under the central wafer portions, is compressed for a greater percentage of the polishing time than are the inner and outer pad regions 24 and 28, which only contact the wafer edges. Consequently, the effective elastic modulus decreases faster in the central pad region than at the inner and outer regions, and the polishing rate after initial break in is therefore progressively lower at the wafer centers than at the wafer edges.

Another characteristic of polishing pads used for oxide CMP is that they become smoother with increasing polishing time, which degrades their slurry-retaining characteristics as well as their capability of mechanically wiping off the soft, chemically reacted layer from the oxide surface. This results in a decrease in removal rate. To counteract this smoothing tendency, polishing pads for oxide CMP typically undergo a conditioning process during or after wafer polishing.

Conditioning is generally performed by a rotating conditioning disk mounted on an arm above the polishing pad, as shown in FIG. 1. The mounting arm is generally computer controlled, and can sweep the conditioning disk across the polishing pad as the platen rotates. The sweep may be along an arch on the pad, or in the radial direction. By way of example, the APP-1000 Pad Conditioner built by Westech divides the polishing pad into ten segments along the radial direction. The rotation speed of the conditioning disk and the conditioning time at each segment can be programmed. The conditioning disk can be of various forms, including having embedded particles such as diamond. As the conditioning disk is rotated over the polishing pad, it roughens the pad surface. The amount of roughening, i.e., conditioning, at any location on the pad depends on parameters such as the conditioning time at that location, the downward force applied to the conditioning disk, the rotation speed of the conditioning disk, and the platen rotation speed. These parameters form the so-called conditioning recipe.

While conditioning the polishing pad can prevent the drop in removal rate by roughening the pad surface, removal rate reaches a saturation value at a certain conditioning time, known as the saturation conditioning time, and does not increase further with further conditioning. Furthermore, excess conditioning at any location causes pad thinning, thereby decreasing the polishing pressure and removal rate at that location. By way of example, an overconditioned central pad region can result in the dielectric polishing profile illustrated in FIG. 4. Overconditioning also adversely affects polishing pad lifetime due to cumulative pad thinning.

Generally, the conditioning recipe for the pads used in CMP production processes is a fixed process determined before polishing, according to empirically derived parameter values which are chosen to minimize WIWNU and maximize stability of average removal rate. Conditioning different regions of the polishing pad for different amounts of time is known as selective conditioning. Selective conditioning is facilitated by apparatus such as the aforementioned APP-1000 conditioner which allows user programming of the conditioning recipe at each pad segment. Selectively overconditioning pad regions which have higher removal rate can tailor the pad thickness profile and consequently the distribution of the strain field, to yield a more uniform removal rate across the wafer. An example of a fixed selective conditioning recipe is described by K. Acuthan et al in "*Selective Conditioning and Pad Degradation Studies on Interlayer Dielectric Films*", Proceedings, 1996 CMP-MIC Conference, ISMIC, 1996, pp 32–39.

A fixed conditioning process, however, even selective conditioning, cannot compensate for such factors as the aforementioned gradual and non-uniform changes in pad elasticity and thickness. Additionally, other factors may contribute to non-uniformity of removal rate, such as 1) manufacturing variations in polishing pad thickness and other pad physical and chemical properties, 2) carrier film wear, 3) conditioning wheel wear. These factors are also difficult to counteract with a fixed conditioning recipe. As a result, WIWNU of removal rate tends to increase as more wafers are polished. When the WIWNU exceeds specification, the polishing pad must be replaced.

A CMP apparatus which employed feedback of polishing data to progressively optimize the conditioning recipe would provide improved WIWNU, as well as increasing polishing pad lifetime.

SUMMARY OF THE INVENTION

According to my invention, computerized feedback from film thickness measurements during polishing is utilized to progressively optimize the pad conditioning recipe.

An object of this invention is to provide an improved apparatus and method for Chemical Mechanical Polishing in an integrated circuit manufacturing process.

A further object of this invention is to provide an apparatus and method for Chemical Mechanical Polishing which increases polishing pad lifetime.

A further object of this invention is to provide an apparatus and method for Chemical Mechanical Polishing which decreases within-wafer-non-uniformity (WIWNU of removal rate.

A further object of this invention is to provide an apparatus and method for Chemical Mechanical Polishing which automatically corrects the non-uniform effects of pad wearing, changes in physical and chemical pad properties, and polisher parameter variations in order to achieve lower WIWNU of removal rate.

A still further object of this invention is to provide an apparatus and method for Chemical Mechanical Polishing which progressively optimizes the conditioning recipe for the polishing pad.

A still further object of this invention is to provide an apparatus and method for Chemical Mechanical Polishing which employs feedback of polishing data to determine the progressively optimized conditioning recipe for the polishing pad.

DETAILED DESCRIPTION OF THE INVENTION

Figure 1:
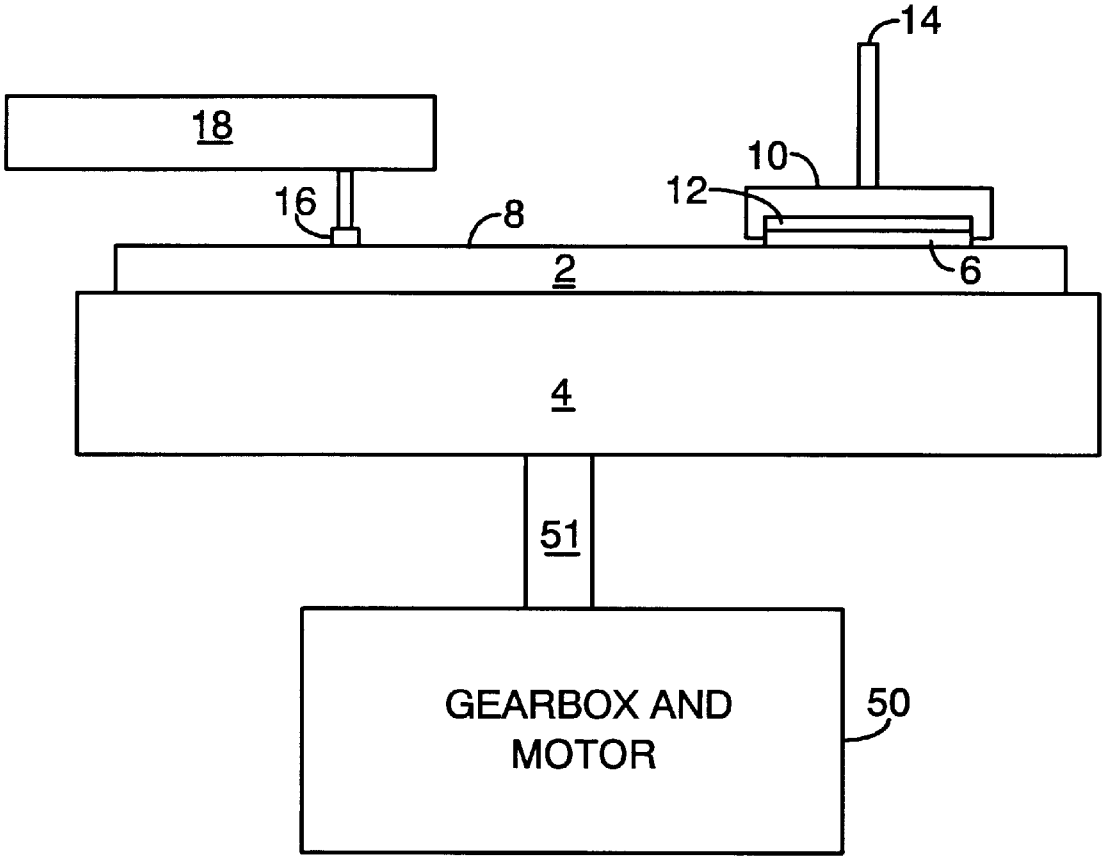
FIG. 1 PRIOR ART
FIG. 1 is a side view of a CMP polisher configuration.

FIG. 1 shows a typical CMP polisher configuration. Polishing pad 2 is attached to rotating platen 4 which is driven by gearbox and motor 50 via driveshaft 51. Wafer 6 is inverted onto top surface 8 of pad 2. Wafer carrier 10 and carrier film 12 exert substantially uniform downward pressure on wafer 6, and cause wafer 6 to rotate about carrier axis 14. Conditioner wheel 16 is mounted on conditioner arm 18, and is computer-controlled to sweep across the surface of pad 2 to condition the pad.

Figure 2:
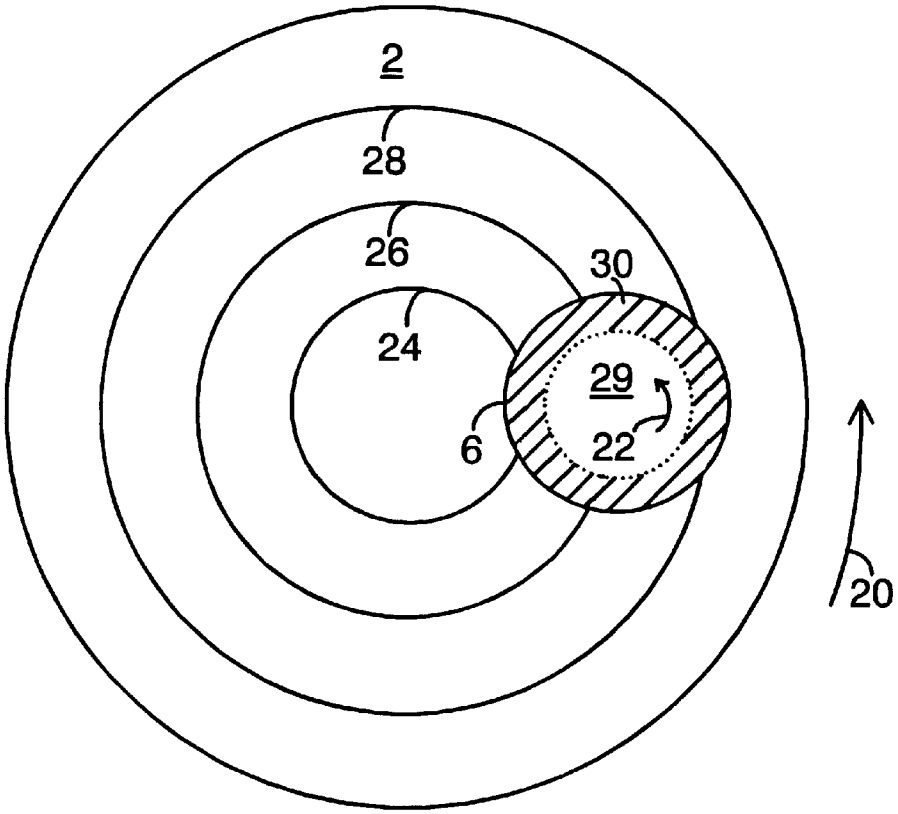
FIG. 2 PRIOR ART
FIG. 2 is a top view of a CMP polisher with a wafer thereon.

FIG. 2 shows a top view of polishing pad 2 and wafer 6 thereon. Pad 2 rotates in the direction of arrow 20, and wafer 6 rotates in the direction of arrow 22. Tracks 24, 26, 28 are defined as inner, middle, and outer tracks respectively on pad 2. Middle track 26 corresponds to the portion of pad 2 which passes under the central region 29 of wafer 6 during polishing, and thereby polishes all of wafer 6. Inner and outer tracks 24 and 28 pass under the edges 30 only of wafer 6, and thereby polish the edge region 30 only. Middle track 26 experiences greater integrated compression than do inner and outer tracks 24 and 28. This can cause faster smoothing and faster wearing of middle track 26, as well as lowering its elastic modulus and thereby decreasing pressure exerted on wafer 6 in its central region 29.

Figure 3:
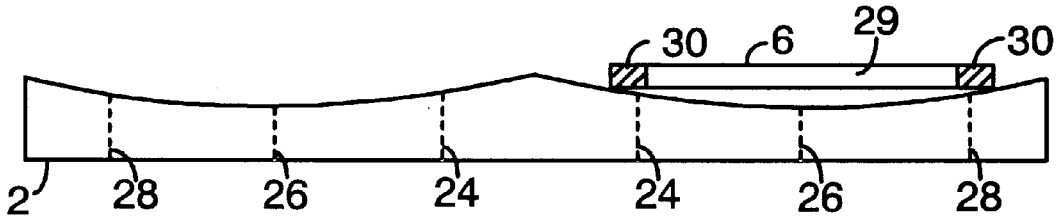
FIG. 3 PRIOR ART
FIG. 3 is a side view of a conditioned polishing pad with a wafer thereon.
Figure 4:
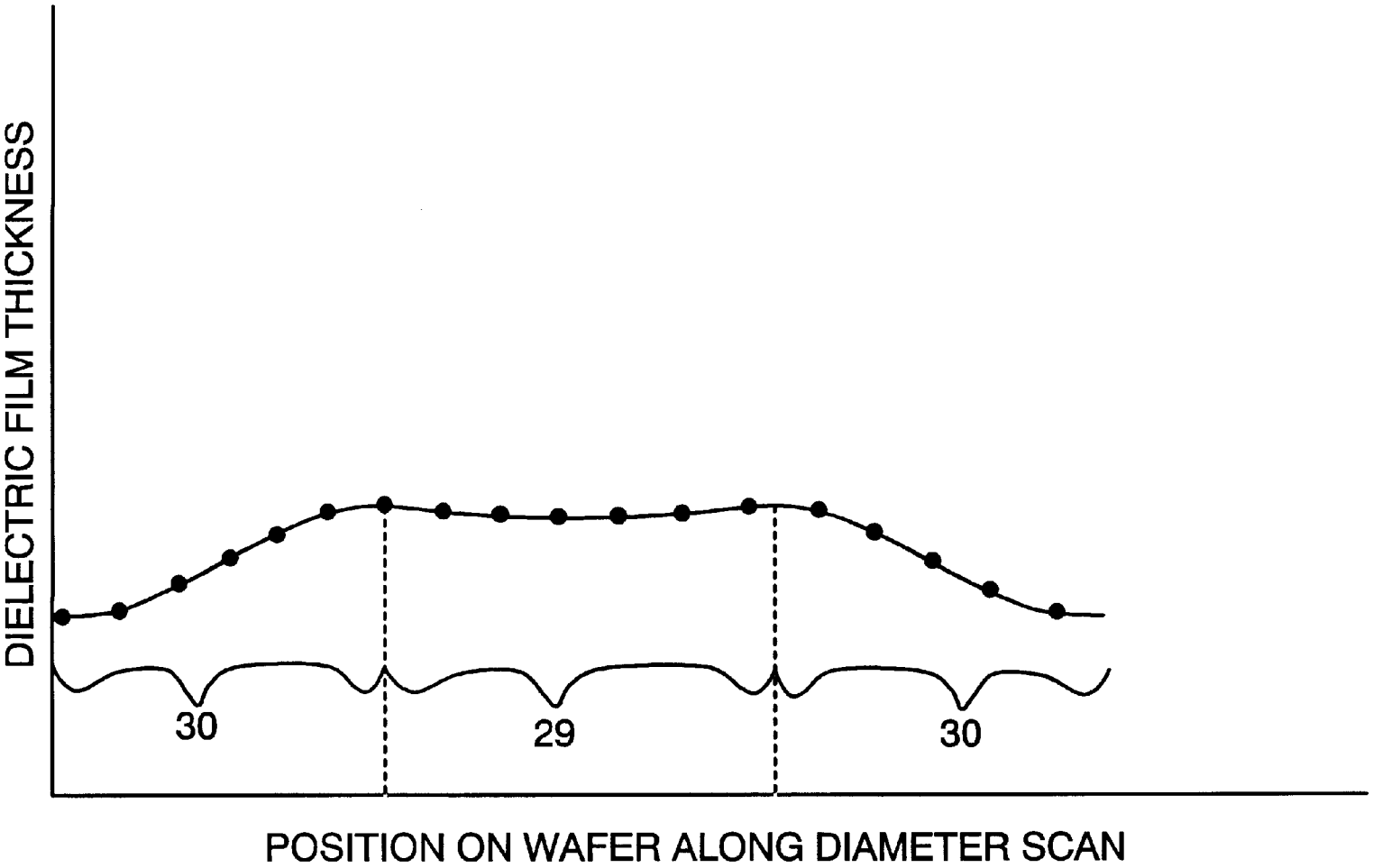
FIG. 4 is a film thickness profile showing edge-fast polishing.

FIG. 3 shows a typical prior art side view of a polishing pad 2 and a wafer 6 thereon. Pad 2 is thinner in the regions corresponding to middle track 26. This may be due to overconditioning of middle track 26 to compensate for its faster smoothing, or may be caused by faster pad wearing in middle track 26. According to the pad profile illustrated in FIG. 3, removal rate in the central portion 29 of wafer 6 is lower than removal rate in edge regions 30, resulting in a so-called edge-fast polishing profile. Such a profile is illustrated in FIG. 4, where thickness of a dielectric film is measured across a radius of a wafer. Edge regions 30 show smaller film thickness than does center region 29. Using prior art polishing apparatus and methods, WIWNU can be as high as 20% across an 8-inch wafer.

According to my invention, film thickness measurements are taken across a polished wafer and utilized in a feedback loop to progressively optimize the conditioning recipe so as to counteract non-uniform effects which cause WIWNU. By way of example, if film thickness measurements indicate edge-fast polishing as in FIG. 4, the inner and outer pad tracks can be conditioned for a longer time than the middle track, thereby reconfiguring the pad thickness profile to provide more uniform pressure across the wafer. The relative thickness of the central track compared with the inner and outer tracks gradually increases to compensate for its decreasing elastic modulus. As will be described hereinafter, a mathematical algorithm can provide more precise information relating the film thickness measurements to the optimum conditioning parameters.

Figure 5:
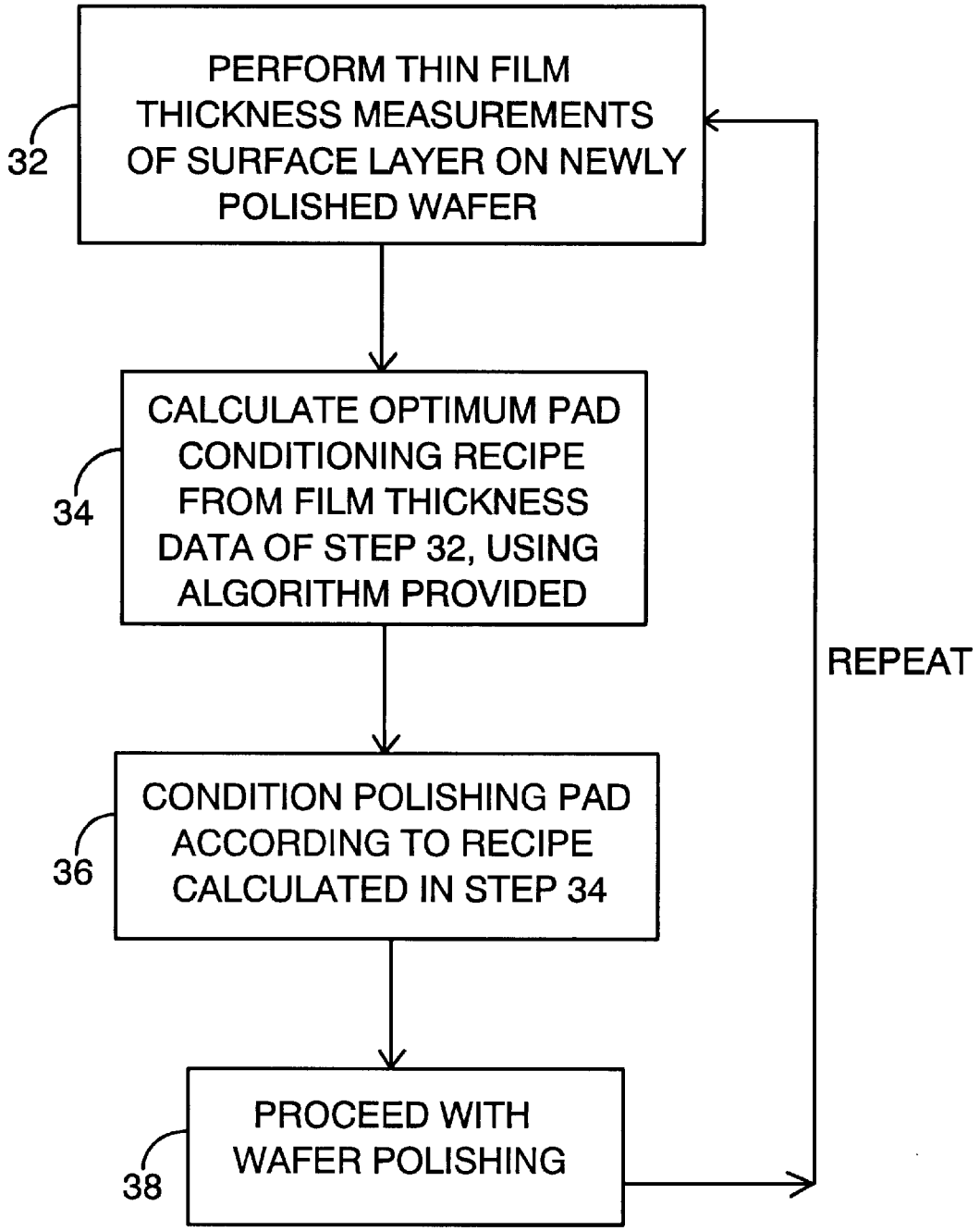
FIG. 5 is a flow chart of a feedback loop utilized in a CMP process.

FIG. 5 is a flow chart illustrating implementation of the aforementioned feedback loop into a CMP process. In step 32, a newly polished wafer having a layer of dielectric thereon, by way of example, is subjected to film thickness measurements provided by a thin film thickness measurement tool. The film thickness profile across diameters of the wafer is determined. In step 34, the optimal pad conditioning recipe at that time is calculated according to an algorithm which employs as input data the film thickness profile data as measured in step 32. In step 36, the pad is conditioned according to the optimal recipe as calculated in step 34. In step 38, wafer polishing continues. This feedback loop can be employed with user-determined frequency to progressively optimize the conditioning recipe and to maintain low values of WIWNU.

Apparatus utilized to implement the feedback loop includes: 1) a thin film thickness measurement tool to provide thickness data: this tool may be positioned on the polishing apparatus so as to provide in situ measurements, or it may be in a location removed from the polishing apparatus. The tool may use optical, electrical, acoustic, or mechanical measurement methods. A possible thin film thickness measurement tool is the Prometrix 650 made by Tencor Instruments. 2) a computer to calculate the optimal pad conditioning recipe from the measured film thickness data, employing an algorithm provided for performing the calculation, and 3) a computer-controlled pad conditioner to automatically provide conditioning according to the calculated conditioning recipe.

An example of an algorithm for calculating the conditioning recipe from film thickness data is described hereinafter. This algorithm is utilized in the best mode embodiment of my invention.

Figure 6:
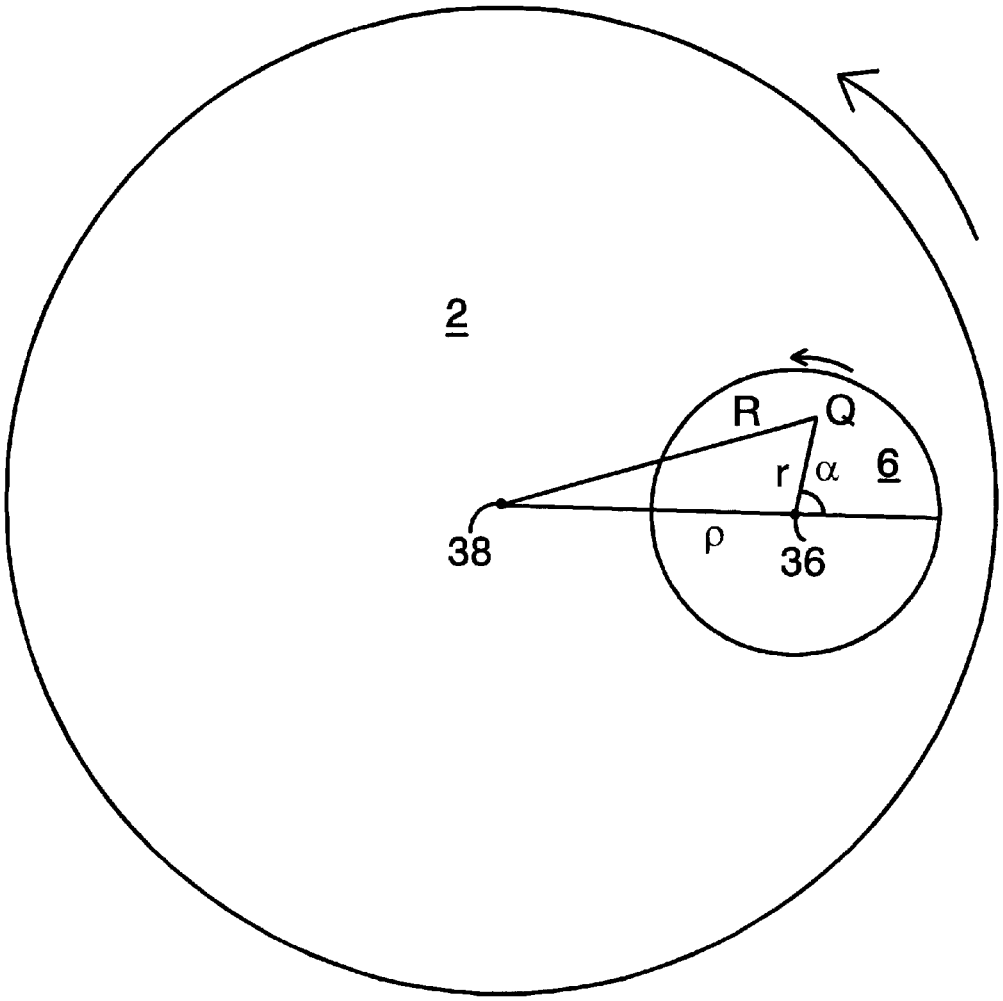
FIG. 6 is a diagram of geometrical quantities utilized in a feedback algorithm.

FIG. 6 illustrates the geometrical quantities employed in deriving the algorithm. A point Q on a wafer 6 has position (r,α) relative to the center 40 of the wafer. Point Q is at radial distance R from the center 42 of pad 2. Center 40 of wafer 6 is a distance p from center 42 of pad 2. Wafer 6 rotates with angular velocity ω, pad 2 rotates on platen 4 with angular velocity Ω.

Generally, removal rate for CMP evidences good circular symmetry on the wafer. Let f(r) denote the removal rate at radius r averaged over the angle α. Normalized removal rate F(r) expresses the ratio of removal rate at radius r to average removal rate across the wafer. The average removal rate across the wafer is expressed as $$\frac{\int_0^{r_0} f(r)2\pi r dr}{\pi r_0^2} = \frac{2}{r_0^2}\int_0^{r_0} f(r) r dr \tag{1}$$

where $r_0$=radius of the wafer. The normalized removal rate is therefore $$F(r) = \frac{f(r)}{\frac{2}{r_0^2}\int_0^{r_0} f(r) r dr} \tag{2}$$

Normalized removal rate F(r) can also be expressed according to a normalized form of Preston's equation, applied to a specific point on the wafer, as $$F(r) = \frac{-\frac{dT(r)}{dt}}{2\pi\int_{r=0}^{r_0}\frac{dT(r)}{dt}dr} = \frac{1}{2\pi}\int_0^{2\pi} P(R)\sqrt{\left[1+\left(\frac{r}{\rho}\right)^2\left(\frac{\omega}{\Omega}-1\right)^2 - 2\left(\frac{r}{\rho}\right)\left(\frac{\omega}{\Omega}-1\right)\cos\alpha\right]}\,d\alpha \tag{3}$$

where P(R) is the normalized local pressure exerted on the wafer at radius R, with the assumption that pressure is a function of R only, and where $$R = \sqrt{\rho^2 + r^2 + 2\rho\cos\alpha} \tag{4}$$

This is a good approximation in most instances, since most sources of WIWNU evidence circular symmetry on the pad. P(R) is normalized by the average pressure across the wafer, and therefore has a value near unity. The square root term in Equation (3) is the ratio between the velocity of point Q relative to the polishing pad and the velocity of the center of the wafer relative to the polishing pad. The velocity of the center of the wafer relative to the polishing pad is Ωρ. Equation (3) assumes carrier rotation only; however, certain polishing systems add carrier oscillation in the radial direction of the pad, which causes ρ to vary periodically. For such a system, equation (3) would be modified by averaging ρ over its range.

To aid in numerical calculations, equation (3) can be approximately expressed in discrete form. The polishing pad is divided into N annular segments each having width Δ, the radius of the jth segment being $R_j$. The normalized removal rate at radius $r_i$ on the wafer is approximately equal to $$F(r_i) = \sum_{j=1}^{N} P(R_j)C_{ij}, \qquad i = 1, 2, 3, \ldots L,\ L \geq N \tag{5}$$

where $$C_{ij} = \frac{1}{I}\sum_{k=1}^{I}\delta\left(R_j - \sqrt{\rho^2 + r_i^2 + 2\rho r_i\cos\frac{\pi k}{I}}\right)\sqrt{1+\left(\frac{r_i}{\rho}\right)^2\left(\frac{\omega}{\Omega}-1\right)^2 - 2\frac{r_i}{\rho}\left(\frac{\omega}{\Omega}-1\right)\cos\frac{\pi k}{I}} \tag{6}$$

I is an integer which should be chosen to be sufficiently large to yield a good numerical approximation. A value of 30 for I is expected to yield good results. The δ function is defined as $$\delta(x) = \begin{cases} 1 & \text{if } -\frac{\Delta}{2} < x < \frac{\Delta}{2} \\ 0 & \text{otherwise} \end{cases} \tag{7}$$

Equation (5) yields a system of linear equations in $R_f$ Values for $F(r_i)$ may be obtained directly from film thickness measurement data $f(r_i)$ according to equation (2) expressed in discrete form:

$$F(r_i) = \frac{f(r_i)}{\frac{2}{r_0^2}\sum_{i=0}^{L} f(r_i) r_i (r_{i-1} - r_i)} \tag{8}$$

If the measured removal rate is not circularly symmetric, $f(r_i)$ should be obtained by averaging several removal rate measurements taken at the same radius $r_i$ but at different angles $\alpha$.

These values for $F(r_i)$ can be put into equations (5), then equations (5) can be solved to yield corresponding values for $P(R_j)$, using computer linear regression techniques. The resulting values for $P(R_j)$. are then utilized to calculate the optimized conditioning time for each radial pad segment, as described hereinafter.

Unstable solutions to Equations (5) could result from noise in the thickness measurements, or from possible sharp fluctuations in WIWNU due to unforeseen mechanisms. To prevent these unstable solutions from occurring, pressure P can be constrained to be symmnetric with respect to the radial position of the wafer center, $\rho$, by setting $P(\rho+i\Delta)=P(\rho-i\Delta)$, where i is an integer.

Optimizing the conditioning recipe comprises the steps of:

1) setting a predetermined minimum conditioning time $T_{min}$ across the entire pad which is at least as long as the saturation conditioning time $T_{sat}$, so as to maximize the removal rate after conditioning;

2) setting an average conditioning time $T_{average}$ across the pad which is greater than $T_{min}$; $T_{average}$ is the average conditioning time for a single segment of the pad, therefore $NT_{average}$ is the total conditioning time for a conditioning cycle. $T_{average}$ is constrained to remain constant for all conditioning cycles, to avoid upward or downward drift of conditioning times.

3) to avoid the possibility of catastrophically long conditioning times, whether due to an error in film thickness measurement or other sudden large effects, a predetermined maximum conditioning time $T_{max}$ which is larger than $T_{average}$ is set.

4) For the nth conditioning cycle, the pad regions for which the prior removal rate as measured by the film thickness measurement is greater than the average removal rate, i.e., those portions having higher pressure against the wafer, are provided an adjusted conditioning time $T_n$ which is greater than $T_{average}$. The additional conditioning time relative to $T_{average}$ thins the pad more than the average pad thinning amount and lowers the pressure exerted at those regions. The pad regions for which the prior removal rate as measured by the film thickness measurement is lower than the average removal rate, i.e., those portions having lower pressure against the wafer, are provided an adjusted conditioning time $T_n$ which is lower than $T_{average}$. In those regions, the pad thinning is less than the average pad thinning amount. In this way, the pad thickness profile is retailored to yield a pressure distribution providing more uniform removal rate across the wafer, thereby lowering WIWNU.

The adjusted times $T_n(R_j)$, corresponding to the conditioning time for the jth segment during the nth conditioning cycle, are recalculated for each successive cycle according to the local normalized pressures $P(R_j)$ obtained from the feedback thin film thickness data. $P(R_j)$ is compared to the quantity $P_0(R_j)$, where $P_0(R)$ is the normalized pressure distribution which would yield a uniform removal rate across the wafer. $P_0(R)$ can be calculated from equation (3) by setting $F(r)=1$. In a preferred embodiment of this invention, the conditioning time $T_n(R_j)$ for the nth conditioning cycle is calculated from the conditioning time $T_{n-1}$ of the (n−1)th cycle according to the formula $$T_n(R_j) = \frac{NT_{average}(\lambda(P_n(R_j) - P_0(R_j)) + T_{n-1}(R_j))}{\sum_{i=1}^{N}(\lambda(P_n(R_i) - P_0(R_i)) + T_{n-1}(R_i))} \tag{9}$$

when this formula has a value between $T_{min}$ and $T_{max}$, but having lower and upper bounds $T_{min}$ and $T_{max}$ respectively. $\lambda$ is a feedback strength coefficient experimentally determined for each specific CMP process to provide fast correction of the pad profile with minimum overshooting. It may depend on such parameters as the material being polished, the downward force exerted by the conditioning wheel, and other details of the polishing apparatus. The accuracy of equation (9) assumes a pad conditioner which is small with respect to the polishing pad, and can therefore accurately tailor the pad profile.

Equation (9) forms the calculated conditioning recipe based on the measured film thickness data, in the best mode embodiment utilizing the algorithm described above. This calculated recipe is automatically implemented by the computer-controlled conditioning arm. The feedback loop can be implemented with user-determined frequency to progressively optimize the conditioning recipe.

Figure 7:
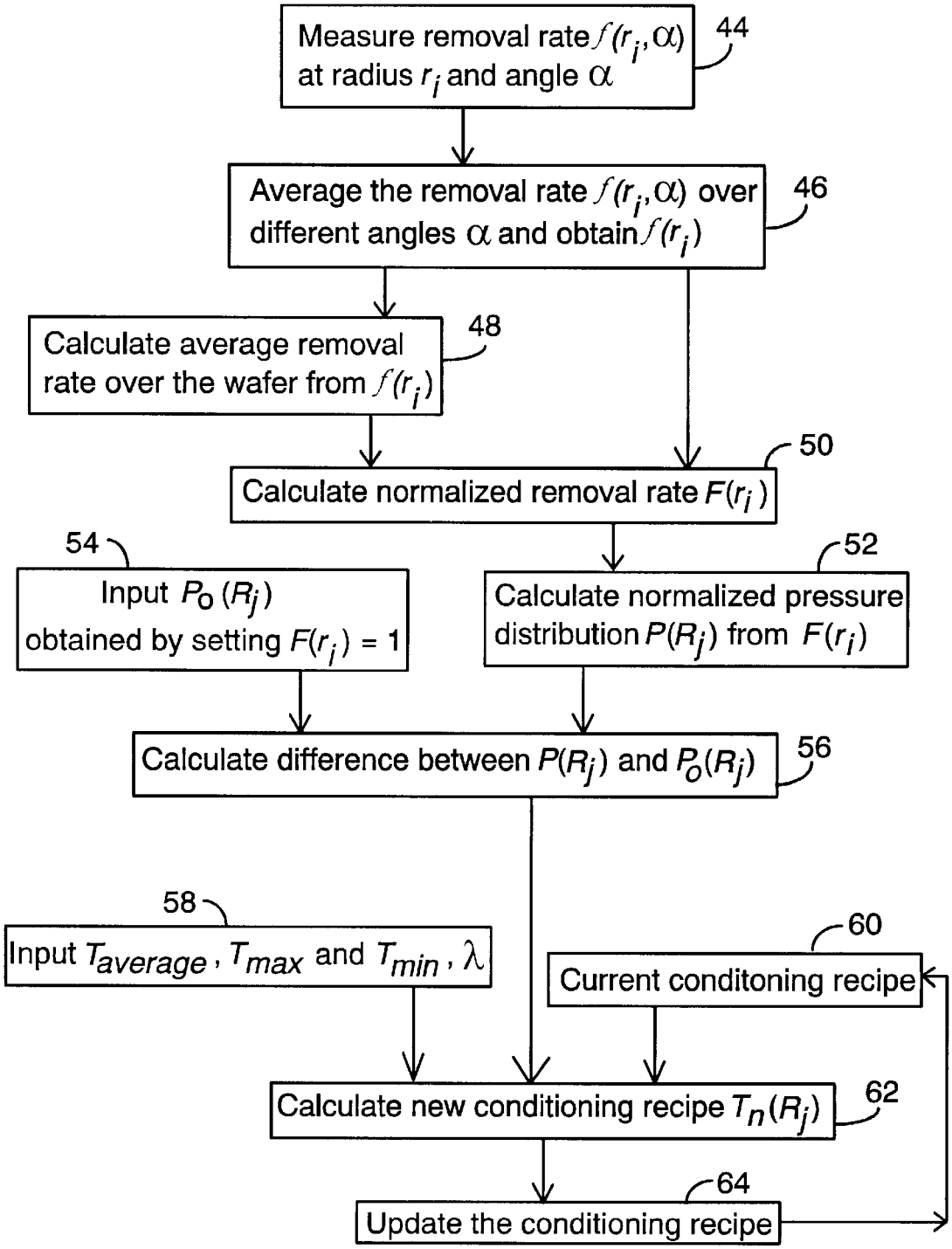
FIG. 7 is a flow chart of a sample feedback algorithm.

FIG. 7 summarizes the preferred embodiment of the feedback algorithm in flow-chart format. In step 44, the removal rate is calculated across the wafer as a function of radius $r_i$ and angle $\alpha$, according to thin film thickness measurements obtained in step 32, FIG. 5. In step 46, the removal rate is averaged over $\alpha$ to obtain a radial removal rate distribution $f(r_i)$. In step 48, the average removal rate is calculated from the removal rate distribution, and in step 50 the normalized removal rate distribution $F(r_i)$ is calculated from $f(r_i)$ and from the average removal rate of step 48. $F(r_i)$ is used to calculate actual normalized pressure distribution $P(R_j)$ in step 52, and the calculated ideal normalized pressure distribution $P_0(R_j)$ is input in step 54. The difference between these two normalized pressure distributions is calculated in step 56. In step 58, predetermined average, minimum, and maximum conditioning times $T_{average}$, $T_{max}$, and $T_{min}$ and feedback constant $\lambda$ are input, and are utilized, along with current conditioning recipe 60, to calculate new conditioning recipe $T_n(R_j)$ in step 62. In step 64, the conditioning recipe is updated such that the new conditioning recipe of step 62 replaces the current conditioning recipe 60. Steps 44–64, outlining the flow of the algorithm, correspond to step 34 in FIG. 5. The polishing pad is then conditioned according to the new conditioning recipe, and wafer polishing continues, as in steps 36–38, FIG. 5.

A similar algorithm can additionally be utilized for re-shaping of polishing pad thickness profiles for new pads or for pads which yield WIWNU out of specification. In these two instances, the re-shaping of the thickness profile would generally be a single conditioning cycle involving a more extensive use of the conditioner than would the simple adjustment for non-uniform drift of polishing parameters, as described by equation (9). As a result, the feedback coefficient would generally have a different, larger value. By way of example, assuming $P(R_j)-P_0(R_j)$ is minimum at j=k, the reshaping times $T(R_j)$ for segment j at radius $R_j$ could be expressed as $$T(R_j) = \begin{cases} T_{\min} & \text{if } j = k \\ \beta((P(R_j) - P_0(R_j)) - (P(R_k) - P_0(R_k))) + T_{\min} & \text{if } j \neq k \end{cases} \quad (10)$$

where β is a feedback constant for re-shaping the pad profile. β is also experimentally optimized for each specific CMP process. A maximum reshaping time $T_{max}$ may be set by the user; by way of example, $T_{max}=5\beta$.

Although the algorithm as described above for calculating conditioning times from film thickness data is employed in the best mode embodiment of my invention, it is only one example of possible feedback loop calculation algorithms and methods which may be utilized. By utilizing feedback from the film thickness profile to adjust the conditioning recipe and reshape the polishing pad thickness profile, initial WIWNU for new polishing pads can be minimized, and non-uniform pad wearing and elastic property variations can be quickly and progressively corrected, thereby minimizing the increase in WIWNU with polishing time. Experimental results using the feedback technique show WIWNU consistently reduced from the prior value of 9.7% down to 4.3% without changing the pad, after polishing three lots of product wafers. To avoid relaxation of pad physical properties, the best mode embodiment of the feedback loop requires uninterrupted polishing mode: i.e., polishing is not halted during film thickness measurements. A simple way to implement this best mode is to remove one test wafer in the middle of a polishing cycle and to perform film thickness measurements, feedback loop calculations, and adjustment of the conditioning recipe during the completion of the cycle.

By lowering WIWNU, my invention will increase wafer yield, lower manufacturing costs by increasing polishing pad lifetime, and improve device functionality and performance.

Whereas my invention as described utilizes a CMP apparatus for polishing dielectric layers with a rotating wafer carrier and platen, and utilizes a specific feedback algorithm, it is not essential that this exact apparatus and algorithm be used. By way of example, certain polishers utilize linear motion polishing pads in place of the rotating pads described herein. In such cases, the algorithm can be modified to extract the normalized effective pressure at different linear segments on the pad. The information obtained can then be used to determine optimal conditioning times for the different linear pad segments. Similar modifications to the algorithm could be made for polishers utilizing orbital motion. The feedback techniques and algorithm can also be applied to metal CMP. The scope of my invention should be construed in light of the claims.

With this in mind, I claim:

1. A method of reshaping a polishing pad profile for use in a Chemical Mechanical Polishing process for integrated circuit fabrication, comprising the steps of:

1) installing a wafer having a thin film thereon in a CMP apparatus having a polishing pad and a conditioning device;
2) polishing said wafer for a period of time;
3) determining a profile across said wafer of a removal rate occurring during said polishing step by measuring a thickness of said thin film across said wafer;
4) calculating, according to said removal rate profile, a reshaping recipe for said pad, to correct non-uniformities in said removal rate;
5) reshaping said pad with said conditioning device according to said calculated reshaping recipe;

wherein said reshaping recipe is calculated by:

6) determining from said removal rate profile, a distribution P across said pad of a pressure exerted by said pad on said wafer during said polishing step;
7) determining an the ideal pressure distribution $P_0$ which yields uniform removal rate across said wafer;
8) determining an optimized reshaping recipe according to P and $P_0$.

2. The method of claim 1, wherein said pad comprises annular segments, the radius of said jth annular segment being $R_j$, and whereby said step of determining said optimized reshaping recipe comprises:

experimentally determining a feedback constant β and calculating said conditioning time $T(R_j)$ for said pad at radius $R_j$ according to the equations $$T(R_j) = \begin{cases} T_{\min} & \text{if } j = k \\ \beta((P(R_j) - P_0(R_j)) - (P(R_k) - P_0(R_k))) + T_{\min} & \text{if } j \neq k \end{cases}$$

wherein P and $P_0$ are functions of radial position R on said pad, wherein $T_{min}$ is a minimum time greater than the saturation conditioning time $T_{sat}$ and wherein $P(R_j)-P_0(R_j)$ is a minimum at j=k.

3. The method of claim 2, wherein said wafer polishing step comprises rotating said wafer with angular frequency ω over said pad rotating with angular frequency Ω, and wherein the step of determining P(R) comprises:

dividing said polishing pad into N annular segments each having width Δ, a radius of the $j^{th}$ segment being $R_j$;

solving the set of equations $$F(r_i) = \sum_{j=1}^{N} P(R_j)C_{ij}, \qquad i = 1, 2, 3, \ldots L, L \geq N$$

to yield P(R), wherein;

$$C_{ij} = \frac{1}{I}\sum_{k=1}^{I} \delta\left(R_j - \sqrt{\rho^2 + r_i^2 + 2\rho r_i \cos\frac{\pi k}{I}}\right)$$

$$\sqrt{1 + \left(\frac{r_i}{\rho}\right)^2\left(\frac{\omega}{\Omega} - 1\right)^2 - 2\frac{r_i}{\rho}\left(\frac{\omega}{\Omega} - 1\right)\cos\frac{\pi k}{I}}$$

$F(r_i)$=said determined removal rate at radius $r_i$ on said wafer;

$$\delta(x) = \begin{cases} 1 & \text{if } -\frac{\Delta}{2} < x < \frac{\Delta}{2} \\ 0 & \text{otherwise,} \end{cases}$$

ρ is a distance between a center of said wafer and a center of said pad; and I is an integer of sufficient magnitude to yield a good numerical approximation of $P(R_j)$ as a function of $F(r_i)$.

4. The method of claim 3, wherein I has a value of at least 30.

5. The method of claim 4, wherein said step of solving said equations comprises performing linear regression.

6. The method of claim 3, further comprising the step of setting $P(\rho+i\Delta)=P(\rho-i\Delta)$, where i is an integer.

7. A method for reducing Within-Wafer Non-Uniformity (WIWNU) of removal rate in a Chemical Mechanical Polishing (CMP) process for integrated circuit fabrication, comprising the steps of:

1) installing a wafer having a thin film thereon in a CMP apparatus having a polishing pad and a conditioning device;

2) polishing said wafer for a period of time;

3) determining a profile across said wafer of a removal rate occurring during said polishing step by measuring a thickness of said thin film across said wafer, 4) calculating, according to said removal rate profile, a conditioning recipe for said pad, to correct non-uniformities in said removal rate;

5) conditioning said pad with said conditioning device according to said calculated conditioning recipe;

6) repeating steps 2) to 5) with user-determined frequency to progressively optimize said conditioning recipe;

wherein said conditioning recipe is calculated by:

7) determining from said removal rate profile, a distribution P across said pad of a pressure exerted by said pad on said wafer during said polishing step;

8) determining an ideal pressure distribution $P_0$ which yields uniform removal rate across said wafer;

9) determining a saturation conditioning time distribution $T_{sat}$ across said pad; and 10) determining optimum conditioning times across said pad according to P, $P_0$, and $T_{sat}$.

8. The method of claim 7, whereby said step of determining optimum conditioning times across said pad comprises:

dividing said polishing pad into N annular segments each having width Δ, a radius of the jth segment being $R_j$, wherein P and $P_0$ are functions of radial position R on said pad;

experimentally determining a feedback constant λ and calculating said conditioning time $T_n(R_j)$ during the nth conditioning cycle, for said pad at position $R_J$, according to the equation $$T_n(R_j) = \frac{NT_{average}(\lambda(P_n(R_j) - P_0(R_j)) + T_{n-1}(R_j))}{\sum_{i=1}^{N}(\lambda(P_n(R_i) - P_0(R_i)) + T_{n-1}(R_i))}$$

said conditioning time further having predetermined lower and upper bounds, $T_{min}>T_{sat}$ and $T_{max}$ respectively, and wherein $T_{average}$ is the average conditioning time across said pad.

9. The method of claim 8, wherein said wafer polishing step comprises rotating said wafer with angular frequency ω over said pad rotating with angular frequency Ω, and wherein the step of determining P(R) comprises:

dividing said polishing pad into N annular segments each having width Δ, a radius of the jth segment being $R_j$;

solving the set of equations $$F(r_i) = \sum_{j=1}^{N} P(R_j)C_{ij}, \qquad i = 1, 2, 3, \ldots L, L \geq N$$

to yield P(R), wherein;

$$C_{ij} = \frac{1}{I}\sum_{k=1}^{I}\delta\left(R_j - \sqrt{\rho^2 + r_i^2 + 2\rho r_i \cos\frac{\pi k}{I}}\right)$$

$$\sqrt{1 + \left(\frac{r_i}{\rho}\right)^2\left(\frac{\omega}{\Omega} - 1\right)^2 - 2\frac{r_i}{\rho}\left(\frac{\omega}{\Omega} - 1\right)\cos\frac{\pi k}{I}}$$

$$\delta(x) = \begin{cases} 1 & \text{if } -\frac{\Delta}{2} < x < \frac{\Delta}{2} \\ 0 & \text{otherwise,} \end{cases}$$

$F(r_i)$=said determined removal rate at radius $r_i$ on said wafer,

ρ is a distance between a center of said wafer and a center of said pad, and I is an integer of sufficient magnitude to yield a good numerical approximation of $P(R_j)$ as a function of $F(r_i)$.

10. The method of claim 9, wherein I has a value of at least 30.

11. The method of claim 10, wherein said step of solving said equations comprises performing linear regression.

12. The method of claim 9, further comprising the step of setting P(ρ+iΔ)=P(ρ−iΔ), where i is an integer.

13. An improved apparatus for performing Chemical Mechanical Polishing (CMP) on a wafer comprising:

a polishing pad;

a thin film measurement device for measuring film profile across said wafer and providing thickness data, wherein said thin film measurement device utilizes methods selected from the group consisting of: optical, electrical, acoustic, and mechanical;

a computer for calculating an optimal conditioning recipe from said thickness data, said computer having an algorithm provided for performing said calculations;

a computer-controlled conditioning device positioned above said pad, to automatically condition said pad according to said calculated conditioning recipe;

wherein said computer algorithm enables adjusted conditioning time $T_n(R_j)$ during the nth conditioning cycle, according to the algorithm for different regions of said pad at position $R_j$, according to the relationship $$T_n(R_j) = \frac{NT_{average}(\lambda(P_n(R_j) - P_0(R_j)) + T_{n-1}(R_j))}{\sum_{i=1}^{N}(\lambda(P_n(R_i) - P_0(R_i)) + T_{n-1}(R_i))}$$

wherein;

said pad is divided into N annular segments;

P(R) is local normalized pressure as calculated from said determined film profile;

$P_0(R)$ is normalized pressure distribution which yields a uniform removal rate;

λ is an experimentally determined constant coefficient for each CMP process;

$T_{average}$ being the predetermined average conditioning time for a single said segment, $NT_{average}$ is the total conditioning time across said pad for a single said conditioning cycle;

said conditioning time further having predetermined lower and upper bounds, $T_{min}$ and $T_{max}$ respectively.

* * * * *